United States Patent [19]

Kress

[11] Patent Number: 4,793,226

[45] Date of Patent: Dec. 27, 1988

[54] MANUAL DEVICE FOR DRIVING SCREWS

[76] Inventor: Willy Kress, Breitenwasen 21, D-7457 Bisingen, Fed. Rep. of Germany

[21] Appl. No.: 21,154

[22] Filed: Mar. 3, 1987

[30] Foreign Application Priority Data

Mar. 4, 1986 [DE] Fed. Rep. of Germany ..... 3606927

[51] Int. Cl.[4] ..... B25B 19/00

[52] U.S. Cl. ..... 81/463; 81/466

[58] Field of Search ..... 81/463, 464, 465, 466, 81/434; 173/93.7, 93-94; 227/9, 10

[56] References Cited

U.S. PATENT DOCUMENTS

| | | | |
|---|---|---|---|
| 2,448,995 | 8/1944 | McCorkhill | 173/93.7 |
| 3,045,242 | 7/1962 | Adolph | 227/10 |
| 3,990,407 | 11/1976 | Parker et al. | 81/464 |
| 4,370,906 | 2/1983 | Gurries | 81/464 |
| 4,428,261 | 1/1984 | Takatsu et al. | 81/434 |

FOREIGN PATENT DOCUMENTS

| | | | |
|---|---|---|---|
| 0780338 | 7/1957 | United Kingdom | 227/9 |

*Primary Examiner*—James G. Smith
*Assistant Examiner*—Lawrence Cruz
*Attorney, Agent, or Firm*—McAulay, Fields, Fisher, Goldstein & Nissen

[57] ABSTRACT

In a manual device for driving screws or similar fasteners, it is proposed that a known power activating mechanism which operates in accordance with the ram setting principle and which exerts an axial force upon a second ram which is disposed behind a first ram be provided, with the second ram, which meshes positively with and is guided in a guide barrel associated thereto, simultaneously performing axial and rotational motions, and that a screw be held on the front portion the second ram in such a manner as to permit it to be driven into an appropriate, mating material.

8 Claims, 1 Drawing Sheet

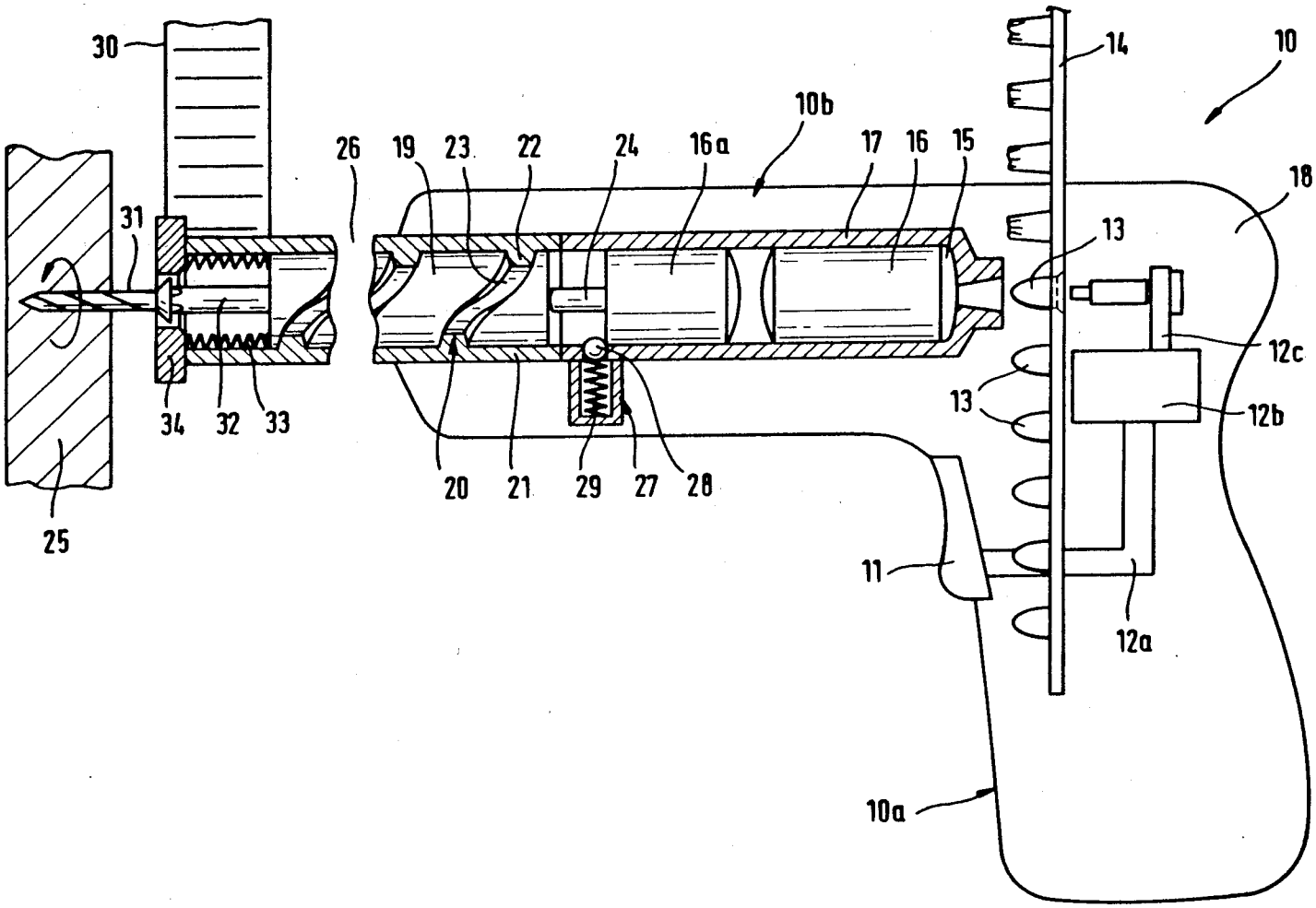
10
18
12c
12b
12a
14
13
13
15
16
17
10b
16a
24
22
23
19
26
28
27
29
21
20
11
10a
33
32
34
31
30
25

MANUAL DEVICE FOR DRIVING SCREWS

PRIOR ART

The present invention is related to a manual device of the type set forth in the heading portion of the main claim. Manual devices of this type, which are customarily termed power screwdrivers, are known in a wide variety of forms; in the simplest instance, they can consist of line-powered hand drills which possess means for clockwise/counterclockwise reversal and, if at all possible, means for varying the speed of the driving electric motor through appropriate actuation of the ON/OFF switch. It is also known practice to operate power screwdrivers of this type on the basis of rechargeable batteries, which then supply the required operating voltage to an appropriately reversible direct-current motor and, to permit recharging, are customarily contained in a so-called battery pack, which can be connected with the manual device by sliding the manual device thereinto, thus simultaneously effecting the electrical connections While the existence of the power cord represents a significant handicap for the user in the case of line-operated power screwdrivers, as it is necessary for the user to always bear the power cord in mind, those devices that are operated by means of rechargeable batteries, which are the devices primarily employed for professional applications, possess the unremediable disadvantage that the batteries will become discharged after a given period of time, which is comparatively short if the power screwdriver is utilized to full capacity, and must then be recharged. Nor is this an acceptable situation even if high-speed charging devices are available. On the other hand, employing two devices alternately, or at least one additional battery pack, involves the disadvantage of additional expense. And, finally, as a result of the high gear ratio that is necessary on order to be able to apply to the head of the screw the torque that is required for driving the screw, work can only be performed at a comparatively slow pace; consequently, fast, disturbance-free work that is not interrupted by waiting periods while the batteries are being recharged, can not be ensured, especially if it is necessary to produce medium-heavy screw fastenings that involve long screw lengths.

On the other hand, it is also known practice to employ power nailers for setting medium-heavy nails in concrete or steel, for example; operating in accordance with a different basic principle, these power nailers are even able to drive nails into heavy concrete or steel. Such known devices (cf. Hilti Nail Shooter DX 350—with Operating Instructions No. W 796780 10-d) operate in accordance with the ram setting principle and contain a ram that slides in a cylindrical guide, which also exerts a cushioning effect upon the motion of the ram, with the configuration of the forward portion of the ram changing into that of a set bolt. Suitably arranged behind the ram is an explosion or combustion chamber, with dynamite power loads of differing caliber, which are matched to the specific application in question in the form of cartridge magazines, being caused to explode; this then forces the ram forward which, in turn, drives out a nail that has been placed in the bolt guide. A device of this type can be employed for uninterrupted, continuous-duty service, whereby it is only necessary to change the cartridge magazine, or the power loads, which are advanced automatically within the pistol grip portion of the device in such a manner as to provide a fresh power load for each shot, and to insert an appropriately configured nail into the device from the front. It is obvious that, since it entails a certain element of handling risk, a device of this type can only be actuated if a special trigger safety is overcome which, for example, can consist of a press-against safety which is designed in such a manner that, by means of a mechanical lock, for example, ignition can be effected only if the device is pressed against an object to be nailed with a given degree of force, whereby a given press-against travel is simultaneously overcome.

It is therefore the object of the present invention to improve the manual device for driving screws which was cited at the outset in such a manner as to also permit screws to be driven by the discharge of power loads, through utilization of the underlying principle upon which the power nailer is based, with the frequently occurring screw driving impediments that are caused by the continuous, dynamic operating principle and the rapid sequence and that otherwise manifest themselves, for example, in the form of slippage of the driving connection between screw head and the respective drive bit, being able to be effortlessly overcome.

ADVANTAGES OF THE INVENTION

The manual device according to present invention solves this object by means of the characterizing features of the main claim and offers the advantage of eliminating the disadvantages which are inherent to known line-operated or battery-operated power screwdrivers, i.e. dependence upon the electrical line or battery discharge, on the one hand, as well as a certain degree of operating cumbersomeness at the beginning of each screw driving procedure, on the other. Thus, the manual device according to the present invention is entirely independent of electrical lines and, through replacement of cartridges which are contained in appropriate disposal strip magazines, can be operated for unlimited periods of time, with the advantage that, as a result of the strong dynamic force that sets in upon discharge and the impact which is produced hereby, it is possible to drive screws or correspondingly designed screw-like fasteners without the need for predrilling or premarking.

While, in the case of battery-operated power screwdrivers, it is also possible to drill a screw into the material by merely positioning and actuating the power screwdriver if certain materials are involved and if Phillips head screws are being driven, this will not always be successful and necessitates considerable manual dexterity. In the case of a battery-operated power screwdriver, the user must, in fact, apply considerable axial force at the outset, when the screw is being positioned, in order to ensure that the screw is driven into the material axially, while simultaneously being subjected to rotational motion—which is the only motion that is capable of being imparted by a battery-operated power screwdriver. If excessive force is applied, however, the entire system will not infrequently buckle at the point at which the screw is being driven, i.e. if the screw bit slips out of the Phillips slotting in the head of the screw. This buckling is bound to occur, as the user will generally not be able to maintain a completely straight, axial line between the screw and the battery-operated power screwdriver that is acting upon it. When buckling occurs as a result of oblique force being applied, the screw that is to be driven falls down and the device strikes the object or the wall into which the screw was to have been driven, where it not infrequently causes scratching or similar undesirable blemishes. Moreover, the suddenness of the occurrence can also represent a possible source of injury to the user. If, on the other hand, insufficient force is applied to a battery-operated power screwdriver, there is a risk that the screw will not be driven at all or that the first turns of its thread will not properly bite.

In contrast thereto, the manual device according to the present invention also produces axial thrust of significant force and magnitude, which is further enhanced by the inertia of the device, itself, which is customarily of medium-heavy weight. In addition to this axial thrust, strong torque is also produced, thus additionally permitting long screws to be driven into complicated materials in a trouble-free manner.

Above all, the driving procedure is accomplished within fractions of a second, whereby the device, itself, endeavors to maintain the connection in the area of the holder for the respective screw, i.e. in the area of the screw bit; in other words, the device endeavors not to slip, as a result of the previously explained effect whereby the holder bit, itself, performs an axial movement which, since the screw is forced to absorb the thrust that results from this axial motion, naturally produces firm engagement between the Phillips slotting in the head of the screw and the screw bit, for example. Moreover, the entire screw driving procedure occurs so quickly that a strong, yet soft and uniform operating sequence is ensured as a result of the dynamic driving effect and the impact of the driving procedure, without any brief, strong counter-torque, which may be developed by the screw during the driving procedure, being able to break the rotational connection or cause this connection to slip.

It is further advantageous that, in addition to the possibility of being able to suitably arrange a screw magazine in the area of the forward attachment to the power screwdriver, thereby permitting screw fasteners to be driven in a virtually continuous manner, without having to re-apply the device, it is also possible to alter both the screw driving velocity and the screw driving depth in any desired manner; the screw driving velocity can be altered by altering the force that is exerted against a screwing ram, which can be effected by appropriately altering the caliber of the cartridges that are placed in the magazine, while the screw driving depth can be altered by appropriate selection of the thread length and/or pitch for the screw ram, which can readily be effected through replacement of the forward inserts.

Nor does the employment of very long threaded guide means for the screw ram pose any problems, as the maximum initial force that is produced against the ram and/or screw ram of the device by the power-load mechanism is significantly smoothed and levelled over the axial length of the device, whereby it is also possible to dispose a screw depth gauge on the front portion of the device, which automatically terminates the screw driving procedure when the screw is completely driven by breaking the engagement that exists between screw head and the holder by means of which it is being driven and held.

Furthermore, the manual device according to the present invention is also able to handle extremely large screws which must be driven into very hard materials. This also represents a preferred field of application; thus, it is therefore conceivable, for example, that screws having very deep threads could penetrate directly into those materials for which a screw driving procedure would previously not have been suitable, at least not without screw anchors, such as concrete, brick or similar walls. This is the case if, for example, mere nailing is to be avoided, as nails do no possess the specific claw action that screws exert in the respective material, and can therefore be extracted again therefrom by means of a gradual, axial pulling effect.

Further embodiments and enhancements of the manual device for driving screws or similar fasteners that is set forth in the main claim are the subject of the measures that are set forth in the subclaims. Especially advantageous in this connection is the possibility of being able to return the operating components that were shifted within the device through the force of the explosion after discharge of the power load and driving of the screw, i.e. the thrust ram and the screw ram, to their original position, in which arresting means then take effect, merely by the rebound of the mechanism, which also includes easy handling of the power screwdriver, as the opposing directions of motion that are caused hereby are more or less offset one against the other by means of the rapid succession in which the sequences occur.

DRAWINGS

The above discussed and other objects, features and advantages of the present invention will become more apparent from the following description thereof, when taken in connection with the practical example shown in the accompanying drawing, which illustrates a highly schematicized side view of the annual device for driving screws according to the present invention, with partial sectional representation.

DESCRIPTION OF PRACTICAL EXAMPLES

Referring now to the drawing, it will be seen that the underlying concept of the present invention is to create a manual device for driving screws or similar fasteners on the basis of and through the employment of the known power-load system of a nail shooter, as explained above, with at least a first ram, which performs merely axial movement within guide means, and a second screwing ram, which is driven thereby and which simultaneously and positively performs both axial and rotational movement, being disposed, the combined motion of the screwing ram being responsible for appropriately driving a screw which is disposed at the front end thereof.

The embodiment of a manual device 10 of this type for driving screws or similar fasteners, which can also be termed a so-called power-load screw shooter, consists of a pistol grip portion 10*a*, as well as the bearing and guide mechanism for the various ram and cylinder assemblies, which are disposed in the barrel area 10*b* of manual device 10.

It will not be necessary to describe the specific design of the trigger portion, the strip magazine guidance portion or the combustion or explosion chamber portion of the manual device in greater detail, as the parts and components that are disposed there, as well as their functions, can be designed in an identical, or at least similar, manner to known nailing devices that operate in accordance with the ram-setting principle; consequently, it will suffice to say that a manually actuated trigger 11 is disposed, whose actuation causes one of the power loads 13 on a strip magazine 14 to discharge by means of suitable linkage, gears and connecting means 12a, 12b, 12c, which are merely suggested in a highly schematic manner in the drawing. Strip magazine 14 can, in a practical manner, be slid into the pistol grip portion from below, being advanced one position upward with every "shot". The explosion that is caused by the discharge of the power load produces its force in a chamber 15, which is defined on at least one side by a first ram 16, which is disposed, in a slidable manner, in appropriate ram guide means 17. Ram guide means 17 can consist of a cylindrical barrel, which is mounted in a suitable manner in a housing 18 of the manual device. The thrust energy that is exerted axially in the direction of guide barrel 17 and which is assumed by at least one or first ram 16 causes this first ram 16 to perform a rapid axial motion to the left, in the plane of the drawing, with a first practical example being able to be designed in such a manner that an unillustrated ramrod-like appendage is attached directly to this ram 16, with the appendage acting upon a further ram 19 and attempting to displace this ram 19, too, in the axial direction. However it is preferable for a further thrust transmission and equalizing ram 16a to be disposed between rams 16 and 19; further thrust transmission and equalizing ram 16a serve to cushion the thrust energy that acts upon it, and to thus make this thrust energy more uniform, while simultaneously ensuring that the force which is produced by ignition of respective power load 13, which originally had a very steep curve, is smoothed and levelled uniformly throughout the axial length and through the respective cushioning effects of the interposed rams.

An axial force acts upon further ram 19 in such a manner that ram 19 is caused to move in the axial direction, as well as to perform a rotational motion, which is brought about by internal threaded toothing 20 that is disposed in the guide barrel associated thereto. Threaded toothing 20 can be designed in such a manner that a female thread 22, for example an Acme thread, is disposed in the interior of guide barrel 21 for rotary ram 19, as it will hereinafter be termed, whereby female thread 22 meshes with a corresponding male thread 23 on rotary ram 19. It is obvious that the pitch of this thread will be selected in such a manner that the axial thrust of ram(s) 16, 16a directly produces rotational motion of rotary ram 19, which, as a result of meshing threads 22 and 23, positively causes rotary ram 19 to be axially displaced, while simultaneously producing its rotational motion.

In this connection, it is possible for the thrust to be transmitted from intermediate ram 16a to rotary ram 19 via a tappet 24, which has a narrow diameter, thus correspondingly reducing the influences of friction between ram 16, or ram 16 and intermediate ram 16a, which perform only axial movement, on the one hand, and rotary ram 19, which, while travelling at the same axial velocity, also simultaneously performs rotational movement.

It is obvious that guide barrel 21, together with rotary ram 19 that is mounted therein, can be made as long as is normally required in order to drive special screws, thereby permitting an appropriate number of turns of thread 20 to be disposed, and thus also ensuring that one single power load will be able to completely drive the respective screw into the material or object 25 against which it is placed. The respectively stipulatable length of guide barrel 21 and its female thread 22 is suggested by the interruption at 26. In this connection, it is advantageous to design the forward portion, consisting of guide barrel 21 and, possibly, rotary ram 19, in the form of interchangeable components, having differing sizes and configurations, that are able to be attached to barrel portion 10b in any desired manner, such as by means of a bayonet lock, for example.

Moreover, it is further advantageous if, to avoid inadvertent discharge, i.e. to ensure that the initial position is only able to be overcome if a given force is exceeded, an arresting safety is also installed, which is illustrated at 27 and which consists, for example, of an arresting ball 28, which is forced through an appropriate opening in ram guide means 17 and into the path of intermediate ram 16a by a tensioning spring 29. If an appropriate force is exerted on intermediate ram 16a, it can easily force ball 28 out of the way, thus initiating the screw driving procedure.

It can further be advantageous to dispose a screw magazine 30 at the forward muzzle area; screw magazine 30, which is merely suggested schematically in the drawing, permits new screws 31 to be supplied and positioned, by means of a suitable, manually actuated feed mechanism, for example, thereby permitting the next screw to always be positioned at the screw holder on rotary ram 19.

In the case of the practical example that is illustrated in the drawing, this holder can be designed merely in the form of a rod-shaped continuation 2 that is connected with rotary ram 19, the front end of rod-shaped continuation 32 being provided with a customary Phillips screwdriver configuration, thereby permitting it to engage the corresponding Phillips head of the respective screw 31 that is to be driven. In addition, the holder can also exert a magnetic holding force upon the screw, in a known manner.

In the, illustrated drawing, the operating components in the plane of the drawing that in to the right of interruption 26 are shown in the initial position, from which they, i.e. rams 16, 16a and rotary ram 19, then initially suddenly move to the left, in the plane of the drawing, upon discharge of the respective power load 13, whereby their motion subsequently becomes more uniform. A screw driving procedure that has already been partially performed is shown to the left of the interruption, whereby rotary ram 19 can strike a stop 33, which is formed by a suitable compression spring or similarly designed resilient stop means, with the screw driving motion, as well as the dynamics of the rotational motion and the concussion being retarded at the end of the screw driving motion, thus preventing the screw from being overdriven.

Numerous modifications, which need not be discussed in detail, as they are obvious to those with skill in the art, are possible at this point; thus, for example, a forward stop plate 34 can be disposed which, acting as a screw depth stop, interrupts the screw driving procedure when the manual device is in a fully contacting relationship with the mating surface of material 25. However it is also possible to commence the screw driving procedure in such a manner that, with rotary ram 19 being retracted sufficiently far into the device, stop surface 34 is in a contacting relationship with the mating surface of material 25 right from the very beginning, whereby the screw driving procedure is continued, with the screw concealed, until the screw has been properly driven into the material. This can readily be implemented by means of suitable stops for rotary ram 19.

It is further possible to dispose appropriate actuation safeties which would then permit power load 13 to ignite and discharge only if an appropriate force is being exerted at the tip of the screw; this can be accomplished by means of suitable sensors, for example, or by means of appropriate mechanical transmission and actuation or release of gear linkage 12*a*, 12*b*, 12*c*. And, finally, it is also possible to electrically monitor both release of the shot and/or its initiation, with numerous suitable sensors, such as pressure sensors and ignition mechanisms, for example, being available. Suitable, rechargeable batteries can also be disposed within the pistol grip portion of the device; these rechargeable batteries would discharge only very gradually, since, in contrast to battery-operated power screwdrivers, it would merely be necessary for them to perform control tasks, while the actual work is effected by ignition and discharge of power load 13.

The present invention has been described above on the basis of preferred practical examples thereof. Obviously, many modifications and variations of the present invention are possible in the light of the above teachings. It should therefore be understood that, within the scope of the appended claims, the present invention may be practiced otherwise than as specifically described. In particular, individual characteristics of the invention can be employed individually or in combination one with the other.

What is claimed is:

1. A manual device for driving screws or similar fasteners in walls and the like including a housing having a piston grip to facilitate handling of the device, means for producing a rotational motion for driving the screw, said housing having support means adapted to support an explodable power source, and a trigger on said housing and being operable to explode the power source to initiate the screw driving procedure, wherein:

(a) a first longitudinally movable ram in said housing;

(b) a rotary ram in said housing mounted for axial and rotational movement when acted upon by said first ram;

(c) a screw holder on said rotary ram for holding the screw to be driven;

(d) a power source in energy exchanging relationship with said first ram for exerting an axial force on said first ram to drive said first ram toward said rotary ram when said power source is exploded by said trigger;

(e) and an intermediate ram between said first and rotary rams wherein to smooth and equalize the transmitted force, said first ram, as it is rebounding under the force of the explosion of said exploded power load, strikes said intermediate ram which, in turn, acts in an axial manner upon said rotary ram, and thread means between said housing and said rotary ram whereby said rotary ram is caused to move forward with coordinated, simultaneous axial and rotational motions and drives a screw which is at least indirectly arranged there against into an appropriate mating material.

2. The manual device according to claim 1 wherein said housing includes a guide barrel receiving at least said rotary ram therein, and said thread means between said rotary ram and said guide barrel comprises an Acme thread of appropriate pitch and of a length which is matched to the respective screw that is to be driven, said length being such that said screw being held by said rotary ram is able to be driven into said mating material with one explosion of said power source.

3. The manual device according to claim 1 wherein said intermediate ram which is axially driven by said first ram acts upon the rear end of said rotary ram, which faces said intermediate ram, by means of a ram-rod extension.

4. The manual device according to claim 1 wherein a stop is disposed which serves to arrest the position of said intermediate ram.

5. The manual device according to claim 4, wherein said stop comprises a ball which is kept partially in the path of said intermediate ram under spring tension.

6. The manual device according to claim 1 wherein a screw feed magazine is connected to said screw holder, from which screws which are to be driven are positioned at said holder on said rotary ram in sequence.

7. The manual device according to claim 1, wherein said housing includes a forward guide barrel having said thread means thereon removably connected to the remainder of said housing, whereby said forward guide barrel and said rotary ram are removable and interchangeable for the purpose of adapting them to different types of screws and their differing number of thread turns.

8. The manual device according to claim 1, wherein said rotary ram is movable in said housing between forward and rear positions, and a forward stop spring is disposed in said housing adjacent said rotary ram to bias said rotary ram to its rear position.

* * * * *